United States Patent [19]

Richards

[11] Patent Number: 4,786,549

[45] Date of Patent: Nov. 22, 1988

[54] WARP KNIT FABRIC WITH RAVEL RESISTANT LAID-IN ELASTIC YARNS AND METHOD FOR MANUFACTURING SAME

[75] Inventor: David T. Richards, Palmyra, Va.

[73] Assignee: Liberty Fabrics, Inc., New York, N.Y.

[21] Appl. No.: 82,072

[22] Filed: Aug. 5, 1987

[51] Int. Cl.[4] ..... B32B 7/00

[52] U.S. Cl. ..... 428/253; 156/148; 156/292; 156/308.2; 428/230; 428/246; 428/225

[58] Field of Search ..... 428/229, 230, 253, 296, 428/221, 225; 156/148, 308.2, 292

[56] References Cited

U.S. PATENT DOCUMENTS

| | | | |
|---|---|---|---|
| 1,715,482 | 6/1929 | Vorck | 66/192 |
| 3,448,595 | 6/1969 | Baltzer et al. | 66/193 |
| 3,708,836 | 1/1973 | Frolich et al. | 66/195 |
| 3,899,900 | 8/1975 | Jackson | 66/177 |
| 4,044,576 | 8/1977 | Kurz | 66/193 |
| 4,052,866 | 10/1977 | Saunders | 66/193 |
| 4,064,712 | 12/1977 | Sayre et al. | 66/192 |
| 4,096,609 | 6/1978 | Sayre | 28/155 |
| 4,100,770 | 7/1978 | Titone | 66/193 |
| 4,240,160 | 12/1980 | Imboden et al. | 66/178 A |
| 4,244,199 | 1/1981 | Rhode | 66/193 |
| 4,298,643 | 11/1981 | Miyagawa et al. | 428/253 |
| 4,411,142 | 10/1983 | Regenstein | 28/218 |
| 4,551,994 | 11/1985 | Vailati et al. | 66/193 |
| 4,563,382 | 1/1986 | Viel | 428/253 |

*Primary Examiner*—James J. Bell

*Attorney, Agent, or Firm*—Kenyon & Kenyon

[57] ABSTRACT

A warp knit Raschel fabric having unidirectional stretch characteristics and ravel resistant laid-in elastic yarns is produced by laying in two sets of spandex yarns with a set of inelastic knitted yarns. The two sets of spandex yarns cross one another at a multiplicity of contact points. The knitted fabric is subjected to dry heat in a temperature range between 385 and 400 degrees Fahrenheit with causes the two sets of spandex yarns to fuse at the contact points.

32 Claims, 3 Drawing Sheets

WARP KNIT FABRIC WITH RAVEL RESISTANT LAID-IN ELASTIC YARNS AND METHOD FOR MANUFACTURING SAME

BACKGROUND OF THE INVENTION

This invention relates to a warp knit fabric having unidirectional stretch and recovery properties and to a method for manufacturing that fabric. More particularly, this invention relates to a warp knit fabric having ravel resistant laid-in elastic yarns.

Many warp knit fabrics with unidirectional stretch characteristics currently on the market suffer from the problem that elastic yarns or threads in the fabric easily unravel or withdraw from the fabric, for example, upon a cutting of the fabric during manufacturing operations. Such fabrics frequently have elastic yarns of spandex and are knitted on a Raschel knitting machine. A first bar of the knitting machine is generally fully threaded with aninelastic yarn and cooperates with the needles of the Raschel machine to knit the inelastic yarns. A second bar of the Raschel machine is fully threaded with spandex yarns and operates to lay those elastic yarns into the knitted structure of the inelastic yarns.

Several methods for producing a warp knit fabric having unidirectional stretch characteristics have been specifically developed for ensuring that the threads of the fabric are ravel resistant when the fabric is cut. For example, U.S. Pat. No. 4,100,770 to Titone discloses a warp knit fabric in which each wale is formed by a plurality of yarns each having alternating knitted and laid in portions, the knitting and laying of one yard being out of phase with the knitting and the laying in of another yarn. The wales are interconnected by inelastic yarn to form the fabric. Pursuant to the teachings of U.S. Pat. No. 4,244,199 to Rhode, an elastic warp knit fabric has a relatively stiff monofilament inlaid in the fabric between the courses thereof so that reverse portions of the monofilament do not extend to the outer extremities of the fabric. A skirt is provided on one side of the fabric to reduce the likelihood that the monofilament is severed when being connected for use as a waste band for a body conforming garment.

Other patents disclosing warp knit stretch fabrics include U.S. Pat. No. 4,052,866 to Saunders, U.S. Pat. No. 3,448,595 to Baltzer et al., U.S. Pat. No. 1,715,482 to Vorck and U.S. Pat. No. 4,240,160 to Imboden et al. Saunders specifically shows and describes a warp knit fabric comprising chain stitches of inelastic yarn with elastomer yarn laid into each course of the fabric to provide it with unidirectional stretch, substantially inextensible yarn being laid lengthwise in the chain stitches to limit the stretch of the fabric in the direction of the chain stitches. Baltzer et al. relates to a warp knit fabric for bandages and discloses a fabric having wales formed by knitted chains along which thick, highly twisted threads are inlaid, further inlaid yarns each traversing a pair of wales. Vorck discloses a knitted fabric in which rubber strands are firmly bound against removal.

U.S. Pat. No. 4,096,609 to Sayre and U.S. Pat. No. 3,708,836 to Frolich et al. each disclose heat setting or thermofixation of a stretchable warp knit fabric for stabilizing the same. Frolich et al. in particular is directed to a pair of tapes separably fastened to one another, each tape comprising a series of warp chains in which a plurality of yarns have been inlaid in parallel to one another. Sayre discloses the warp knitting of elastic and inelastic yarn into a longitudinally stretchable fabric having warp knitted selvedge along each edge of the fabric for limiting the longitudinal stretchability during heat setting.

An object of the present invention is to provide an improved warp knit fabric of the above-described type and a method for producing the same.

Another, more particular, object of the present invention is to provide such a fabric in which the likelihood of withdrawal of elastic yarns from the fabric is substantially reduced or eliminated.

A concomitant object of the present invention is to provide a method for producing an improved fabric wherein the unraveling of elastic yarns in the fabric is substantially prevented.

A further particular object of the present invention is to provide such a method which can be easily incorporated in the production of conventional warp knit fabrics having unidirectional stretch characteristics, particularly Raschel spandex fabrics.

SUMMARY OF THE INVENTION

A method for manufacturing a knitted fabric having ravel resistant laid-in elastic yarns comprises, in accordance with the present invention, the steps of (a) warp knitting a plurality of inelastic first threads or yarns with a first bar of a knitting machine, (b) simultaneously with the step of warp knitting, laying in a plurality of elastic second threads or yarns with a second bar of the knitting machine so that the second threads are interlooped with the first threads, and (c) also simultaneously with the warp knitting step, laying in a plurality of elastic third threads or yarns with a third bar of the knitting machine so that the third threads each touch at least one of the second threads at a plurality of contact points. The web produced by the knitting machine is heated so that the second and third threads are fused at the contact points.

Pursuant to further features of the present invention, the second and third threads are all made of the same substance, preferably spandex, while the step of heating comprises the application to the knitted web of dry heat with a temperature of 385 to 400 degrees Fahrenheit.

The first, the second and the third bar are preferably a front bar, a back bar and a middle bar of the knitting machine, respectively, the bars all being fully threaded during the knitting and laying in steps.

In accordance with a particular feature of the present invention, the third threads are laid in substantially straight lines. In accordance with another feature of the invention, each of the third threads touches and is fused to a plurality of the second threads.

A fabric manufactured pursuant to the method of the present invention has a plurality of warp knitted inelastic first threads, a plurality of elastic second threads laid in and interlooped with the first threads, and a plurality of elastic third threads each laid in with the first threads and touching at least one of the second threads at a plurality of contact points, the third threads being fused to the second threads at the contact points.

A method in accordance with the present invention is easily incorporated as an improvement in existing warp knitting techniques for producing conventional warp knitted fabrics. Specifically, in the production of a fabric having a first set of yarns or threads knitted to form a multiplicity of parallel wales in a multiplicity of courses and further having a multiplicity of spandex yarns laid in amoung the wales, one bar of a knitting machine is used to knit the inelastic fibers, while a second bar is used to lay in the elastic threads. Pursuant to the invention, a third bar is operated simultaneously to lay in a second set of elastic yarns.

The fusing of the two sets of elastic yarns or threads to one another causes them to lock to the knitted inelastic fibers, thereby preventing an unraveling of the elastic threads.

BRIEF DESCRIPTION OF THE DRAWING

FIGS. 3A and 3B each include a composite diagram of the motion of all the guides of each bar used in a knitting operation and, in addition, the motions of one guide of each utilized guide bar.

DETAILED DESCRIPTION

Figure 1A:
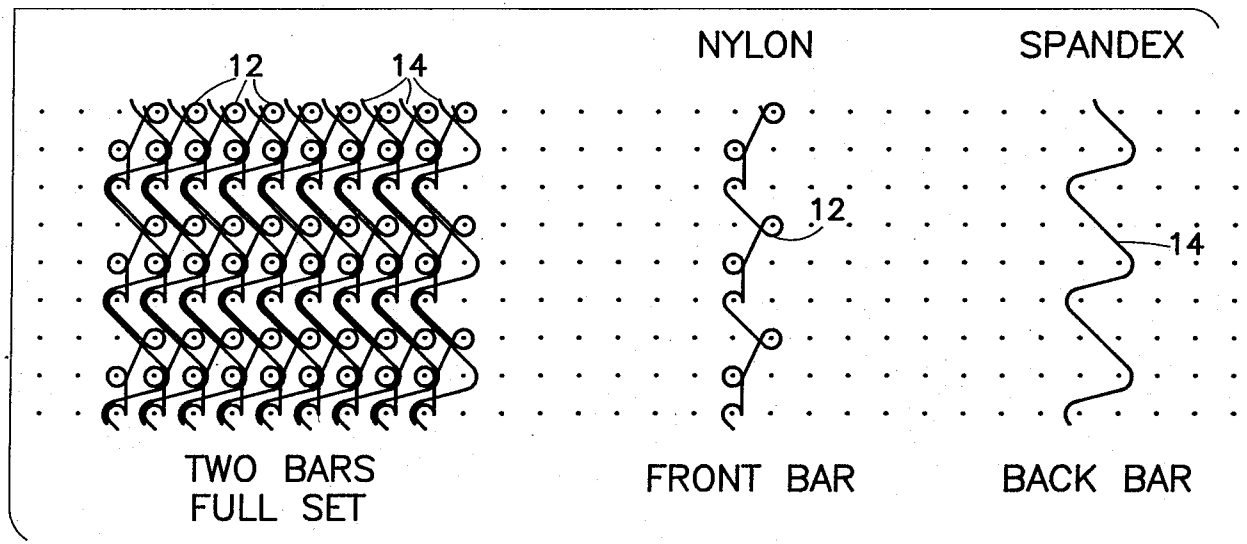
FIG. 1A PRIOR ART
FIG. 1A is a point diagram of knitting motions for a Raschel knitting machine using a first guide bar to knit a plurality of inelastic fibers and a second guide bar to lay in a plurality of elastic threads to produce a conventional satin-type Raschel fabric, showing on the left-hand side of the drawing figure the yarn paths of all bars and guides as would appear in the complete fabric and showing on the right-hand side one guide for each bar of the knitting machine.

A conventional spandex satin-type fabric represented in the composite diagram of the left-hand side of FIG. 1A comprises a multiplicity of knitted inelastic threads, fibers, or yarns 12 knitted by the front bar of a Raschel knitting machine and further comprises a multiplicity of elastic spandex threads or yarns 14 laid in the knitted wales of the elastic threads 12 by a back bar of the knitting machine. The guides of the front bar are fully threaded with the inelastic yarns 12 (see the left-hand side of FIG. 1A), while the guides of the back bar are fully threaded with the spandex yarns 14.

Figure 1B:
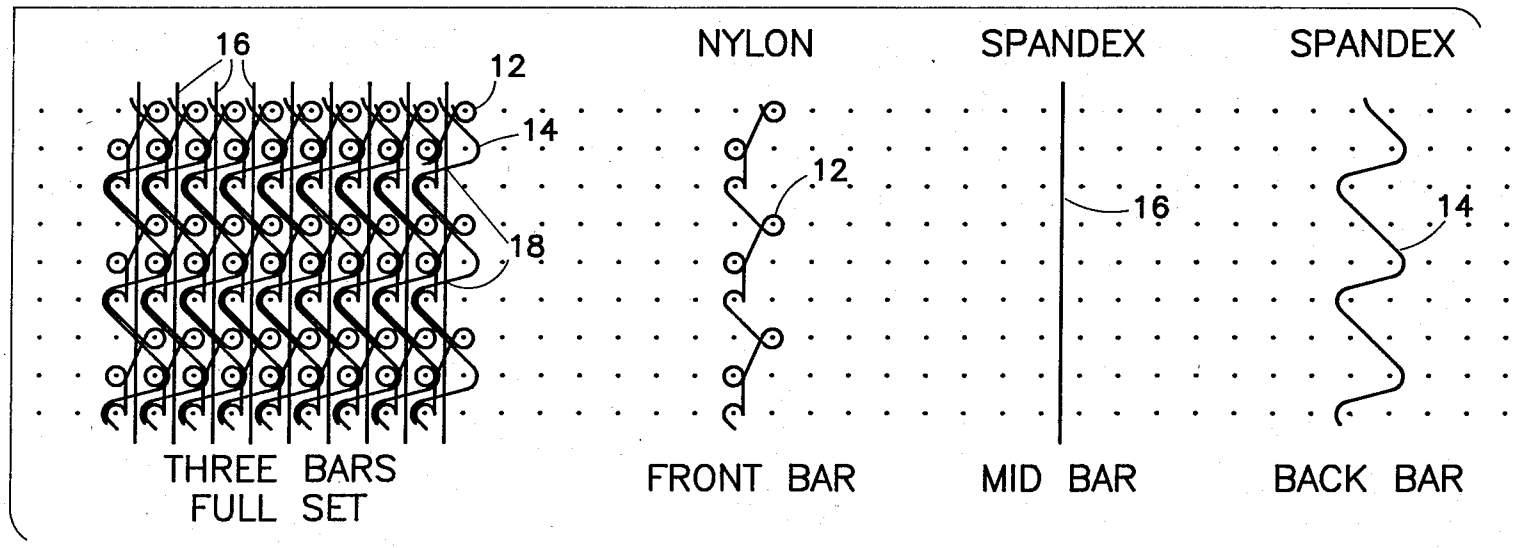
FIG. 1B is a point diagram similar to FIG. 1A, showing in addition to the knitting motions of FIG. 1A the operation of a third bar for laying in a set of second elastic threads in accordance with the present invention.

Pursuant to the invention, a second set of elastic spandex threads or yarns 16 are laid in the satin-type fabric of FIG. 1A by a middle bar of the Raschel knitting machine during a knitting operation. As illustrated in FIG. 1B, the spandex threads or yarns 16 of the second set of elastic threads are laid in substantially straight lines along the wales of the warp knitted fabric. Like the front bar and the back bar, the middle bar of the Raschel knitting machine is fully threaded during the knitting operations. Each of the second spandex threads 16 touches a respective one of the first spandex threads 14 at a multiplicity of contact points 18. In the resulting fabric, the first spandex threads 14 are interlooped with the inelastic knitted threads 12. Upon the formation of the knitted web, the web is heated to fuse the second spandex threads 16 to the first spandex threads 14 at the contact points 18. Preferably, dry heat with a temperature of 385 to 400 degress Fahrenheit is applied to the web to implement the fusing step.

The satin-type Raschel spandex fabric produced by the knitting motions illustrated in FIG. 1B and by the application of heat in accordance with the present invention has the same appearance as the fabric produced by the knitting motions illustrated in FIG. 1A. In addition, the fabric of FIG. 1B has the advantage of a securely anchored set of spandex fibers as an integral part of the fabric. It is to be noted, however, that to produce such an improved satin-type Raschel spandex fabric which is as similar as possible to the conventionally manufactured fabrics, the denier of the spandex threads 14 and 16 in FIG. 1B should be one-half the resultant required denier inasmuch as when the spandex threads are fused to one another, they work in unison and therefore have double the stretch power and recovery force of the spandex in conventional stretch fabrics.

It is to be understood that the fabric shown in FIG. 1B has a substantial degree of stretch in a direction parallel to the wales of the fabric and a limited degree of stretch in a direction perpendicular to the wales. An inelastic yarn is generally used to connect the inelastic threads 12 to one another in the transverse direction.

Figure 2A:
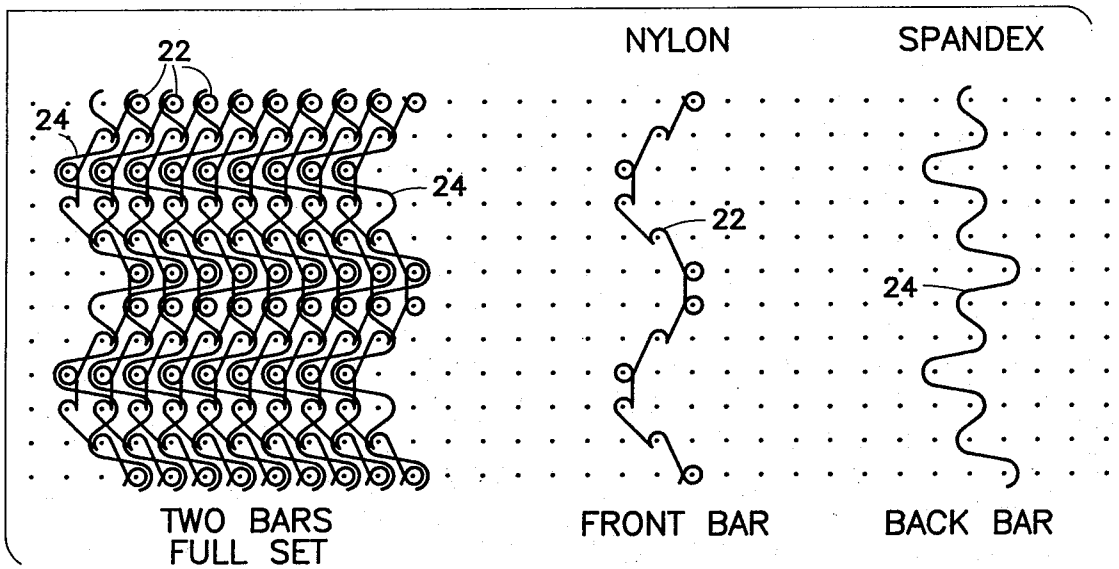
FIG. 2A. PRIOR ART
FIG. 2A is a point diagram of knitting motions for a Raschel knitting machine using a front guide bar to knit a plurality of inelastic fibers and a back bar to lay in a plurality of elastic threads to produce another conventional satin-type Raschel fabric, showing on the left-hand side of the drawing a composite diagram of the yarn paths of all the bars and guides as would appear in the complete fabric and showing on the right-hand side the motion of one guide of each guide bar.

A satin-type Raschel fabric represented by the guide bar motions shown on the left-hand side of FIG. 2A comprises a multiplicity of inelastic nylon threads, fibers or yarns 22 knitted by respective guides on a front bar of a Raschel knitting machine and further comprises a multiplicity of elastic spandex threads or yarns 24 laid by a back bar of the Raschel knitting machine in the wales produced by the knitting of nylon threads 22.

Figure 2B:
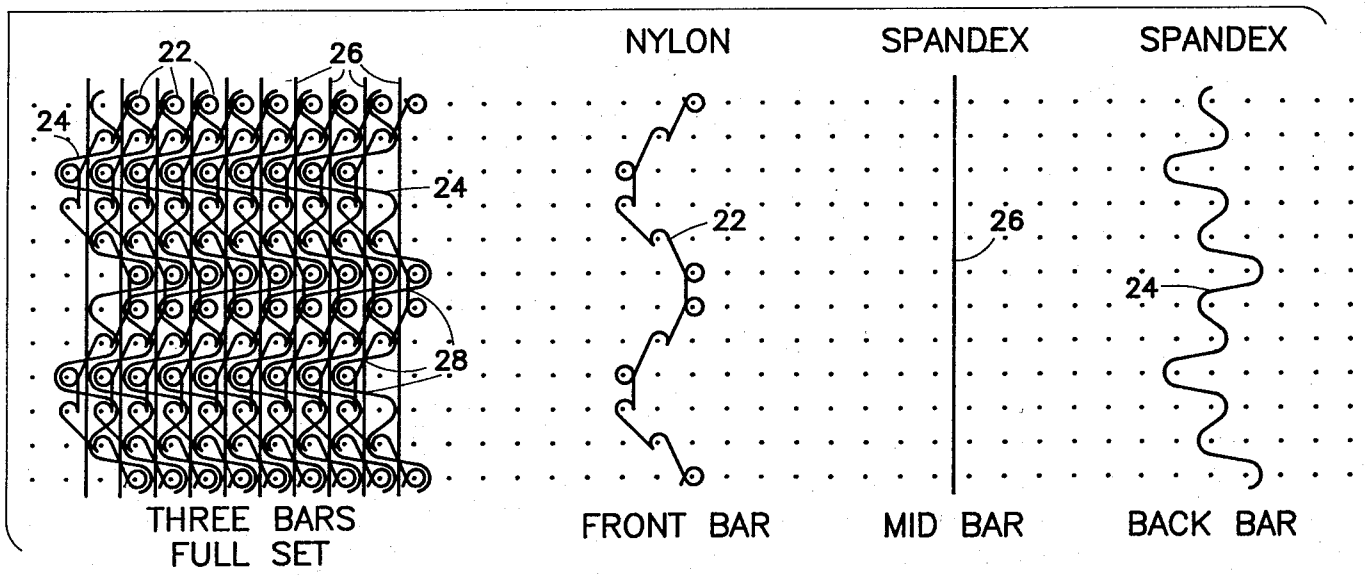
FIG. 2B is a point diagram similar to FIG. 2A, showing in addition to the knitting motions of the front bar and the back bar the operation of a third, middle, bar for laying in a second set of elastic threads in accordance with the present invention.

As depicted in FIG. 2B, the Raschel fabric of FIG. 2A is improved by laying in a second set of spandex yarns or threads 26 by a middle bar of the Raschel knitting machine. Each thread 26 is laid in a substantially straight line along or parallel to the wales of the fabric material and touches or engages each of at least two of the first spandex threads 24 at a plurality of contact points 28. In producing the fabric of FIG. 2B, the front bar, the middle bar and the back bar of the Raschel knitting machine are fully threaded with inelastic nylon yarns or threads 22, spandex threads 26 and spandex threads 24, respectively.

Upon the formation of a knitted web in accordance with the knitting motions of FIG. 2B, the web is subjected to dry heat with a temperature of 385 to 400 degrees Fahrenheit for a time sufficient to fuse second spandex threads 26 to first spandex threads 24 at contact points 28. The fabric produced by the knitting and laying in steps shown in FIG. 2B and the step of heating appears the same as the fabric produced by the knitting motions shown in FIG. 2A, at least to a casual observer. However, not only are the first spandex threads 24 interlooped with the knitted nylon threads 22 but the two sets of spandex threads 24 and 26 are joined to one another to prevent unraveling of the spandex threads. As heretofore described with respect to FIG. 1B, the denier of the spandex threads are chosen to produce a fabric having a predetermined stretchability or spring constant in the direction parallel to the wales.

Figure 3A:
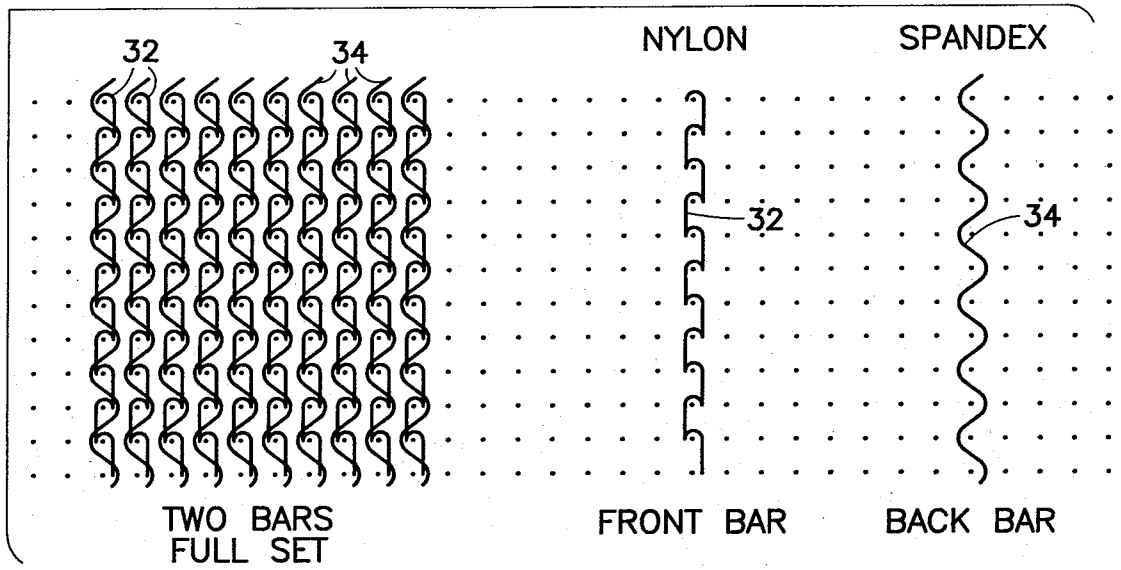
FIG. 3A. PRIOR ART
FIG. 3A is a point diagram similar to FIGS. 1A and 2A, showing the knitting motion of a front bar and a back bar for knitting a plurality of nylon threads and laying in a plurality of spandex threads to produce a conventional spandex lace fabric.

A conventional spandex lace fabric corresponding to the knitting motions shown on the left-hand side of FIG. 3A comprises a first set of inelastic nylon yarns or threads 32 knitted by a front bar of a Raschel knitting machine to form respective wales of the fabric and further comprises a multiplicity of elastic spandex yarns 36 laid by a back bar of the knitting machine in substantially straight (slightly undulating) lines along respective wales of the knitted fabric. The wales are held in a substantially parallel configuration by weft yarns (not illustrated). Such a spandex lace fabric is very prone to spandex withdrawal. In addition, the hard or inelastic yarns 32 are very easy to unrove.

Figure 3B:
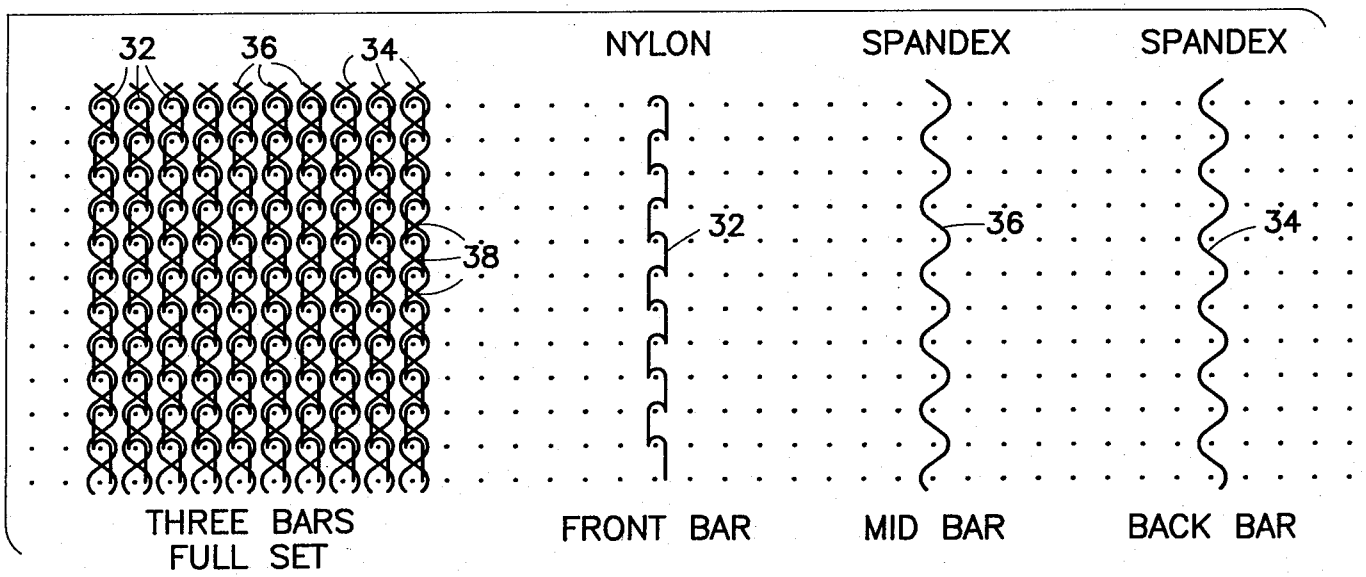
FIG. 3B is a diagram similar to FIG. 3A, showing in addition to the knitting motions of the front bar and the back bar the operation of a middle bar for laying in a second set of spandex threads in accordance with the present invention.

As shown in FIG. 3B, a middle bar of the knitting machine is used to lay in a plurality of second spandex yarns or threads 36 in substantially straight (slightly undulating) lines along respective wales of the fabric. Each of the second spandex yarns 36 crosses a respective first spandex yarn 34 at a multiplicity of crossover or contact points 38.

In knitting the fabric represented by the knitting motions on the left-hand side of FIG. 3B, the front bar, the middle bar and the back bar of the knitting machine are fully threaded with inelastic yarns 32, spandex yarns 36 and spandex yarns 34, respectively. Upon the formation of the knitted web, the web is subjected to dry heat with a temperature between 385 and 400 degrees Fahrenheit for a period of time sufficient to fuse second spandex yarns 36 to first spandex yarns 34 at contact points 38. The fusion of the spandex yarns prevents withdrawal or unroving of those yarns.

It is to be noted that the crossover points 18, 28 or 38 of the first spandex threads 14, 24 or 34 and the second spandex threads 16, 26 or 36 can be increased or decreased to vary the amount of stretch and power of the resulting warp-knit fabric material.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the illustrations and descriptions herein are proffered by way of example to facilitate comprehension of the invention and should not be construed to limit the scope thereof.

What is claimed is:

1. A method for manufacturing a knitted fabric having ravel resistant laid-in elastic yarns, said method comprising the steps of:

warp knitting a plurality of inelastic first threads with a first bar of a knitting machine;

simultaneously with said step of warp knitting, laying in a plurality of elastic second threads with a second bar of said knitting machine so that said second threads are interlooped with said first threads;

also simultaneously with said step of warp knitting, laying in a plurality of elastic third threads with a third bar of said knitting machine so that said third threads each touch at least one of said second threads at a plurality of contact points, said steps of knitting and laying resulting in a web of knitted material; and subsequently to said steps of knitting and laying in, heating said web so that said second threads and said third threads are fused at said contact points, thereby producing the knitted fabric having ravel resistant laid-in elastic yarns.

2. The method defined in claim 1 wherein said second and said third threads are all made of the same substance.

3. The method defined in claim 2 wherein said substance is spandex.

4. The method defined in claim 3 wherein said step of heating comprises the application of dry heat to said web.

5. The method defined in claim 4 wherein said dry heat has a temperature of 385 to 400 degrees Fahrenheit.

6. The method defined in claim 1 wherein said first, said second and said third bar are a front bar, a back bar and a middle bar of said knitting machine, respectively.

7. The method defined in claim 6 wherein said first bar, said second bar and said third bar are all fully threaded during said steps of knitting and laying in.

8. The method defined in claim 7 wherein said second bar moves a greater distance than said third bar during a period of time between each pair of successive knittng cycles.

9. The method defined in claim 8 wherein said third threads are laid in substantially straight lines.

10. The method defined in claim 8 wherein each of said third threads touches and is fused to a plurality of said second threads.

11. The method defined in claim 1 wherein said step of heating comprises the application of dry heat to said web.

12. The method defined in claim 11 wherein said dry heat has a temperature of 385 to 400 degrees Fahrenheit.

13. The method defined in claim 1 wherein said first bar, said second bar and said third bar are all fully threaded during said steps of knitting and laying in.

14. The method defined in claim 1 wherein said second bar moves a greater distance than said third bar during a period of time between each pair of successive knitting cycles.

15. The method defined in claim 1 wherein said third threads are laid in substantially straight lines.

16. The method defined in claim 1 wherein said first, said second and said third bar are a front bar, a middle bar and a back bar of said knitting machine, respectively.

17. The method defined in claim 1 wherein each of said third threads touches and is fused to a plurality of said second threads.

18. A knitted fabric having ravel resistant laid-in elastic yarns, said fabric comprising:

a plurality of warp knitted inelastic first threads;

a plurality of elastic second threads laid in and interlooped with said first threads;

a plurality of elastic third threads each laid in with said first threads and touching at least one of said second threads at a plurality of contact points, said third threads being fused to said second threads at said contact points.

19. The fabric defined in claim 18 wherein said second and said third threads are all made of the same substance.

20. The fabric defined in claim 19 wherein said substance is spandex.

21. The fabric defined in claim 20 wherein said third threads are laid in substantially straight lines.

22. The fabric defined in claim 21 wherein each of said third threads touches and is fused to a plurality of said second threads.

23. The fabric defined in claim 18 wherein said third threads are laid in substantially straight lines.

24. The fabric defined in claim 18 wherein each of said third threads touches and is fused to a plurality of said second threads.

25. A knitted fabric having ravel resistant laid-in elastic yarns, said fabric comprising:

a plurality of inelastic first threads warp knitted by respective guides of a first bar of a knitting machine;

a plurality of elastic second threads laid in with the knitted first threads by a second bar of said knitting machine, said second threads being interlooped with said first threads;

a plurality of elastic third threads laid in with the knitted first threads by a third bar of said knitting machine, said third threads each touching at least one of said second threads at a plurality of contact points, said third threads being fused to said second threads at said contact points.

26. The fabric defined in claim 25 wherein said second and said third threads are all made of the same substance.

27. The fabric defined in claim 26 wherein said substance is spandex.

28. The fabric defined in claim 27 wherein said third threads are laid in substantially straight lines.

29. The fabric defined in claim 28 wherein each of said third threads touches and is fused to a plurality of said second threads.

30. The fabric defined in claim 29 wherein said third threads are laid in substantially straight lines.

31. The fabric defined in claim 25 wherein each of said third threads touches and is fused to a plurality of said second threads.

32. The fabric defined in claim 25 wherein said first, said second and said third bar are a front bar, a middle bar and a back bar of said knitting machine, respectively.

* * * * *